United States Patent [19]

Chamberlain

[11] Patent Number: 4,615,155

[45] Date of Patent: Oct. 7, 1986

[54] MODULAR BUILDING CONSTRUCTION

[76] Inventor: Sam R. Chamberlain, P.O. Box 238, Blanding, Utah 84511

[21] Appl. No.: 752,637

[22] Filed: Jul. 8, 1985

[51] Int. Cl.[4] ..... E04B 7/02

[52] U.S. Cl. ..... 52/90; 52/270; 52/309.7; 52/309.11

[58] Field of Search ..... 52/309.7, 309.9, 309.11, 52/821, 829, 830, 90, 783, 784, 510, 309.12, 585

[56] References Cited

U.S. PATENT DOCUMENTS

| | | | |
|---|---|---|---|
| 2,844,848 | 7/1958 | Couse | 52/309.11 |
| 2,883,711 | 4/1959 | Kump | 52/270 |
| 3,196,499 | 7/1965 | Howener | 52/309.11 |
| 3,254,464 | 6/1966 | Hoyt | 52/309.9 |
| 3,383,817 | 5/1968 | Gregori | 52/309.11 |
| 3,512,819 | 5/1970 | Morgan | 52/309.11 |
| 3,712,004 | 1/1973 | Loesback | 52/270 |
| 3,744,826 | 7/1973 | Hawes | 52/309.9 |
| 3,881,286 | 5/1975 | Smith | 52/90 |
| 3,979,869 | 9/1976 | Beehler | 52/586 |
| 4,114,333 | 9/1978 | Jones | 52/309.11 |
| 4,125,972 | 11/1978 | Pate | 52/90 |
| 4,187,655 | 2/1980 | Anderson | 52/90 |

*Primary Examiner*—Henry E. Raduazo
*Assistant Examiner*—Dan W. Pedersen
*Attorney, Agent, or Firm*—George H. Mortimer

[57] ABSTRACT

The invention relates to modular building construction and to modules for use therein. The modules may be used for floor, wall, ceiling and roof construction in single story and multi-story buildings. The floor, ceiling and roof modules are constructed of at least two sheets of rigid, foamed plastic material such as polyurethane and polystyrene of the same width and length which are offset laterally with respect to each other by 50% of the width and length, thus providing floors, ceilings and roofs of staggered construction. The spaces left in the upper layer by the offset are filled in by partial sheet of the same plastic material of the same thickness so that all the edges of the sheets of the assembled floor, ceiling or roof modules are aligned. T-plates comprising a head and a stem fastened normally to the head are secured adhesively, and, if desired, also mechanically to the edges of the assembled modules with the stem between the sheets, either spaced from each other or provided with grooves to receive the stem, and the head against and secured adhesively to the aligned edge of the sheets of the assembled modules. The wall modules preferably have the two sheets overlying one another so that all edges of the sheets of the module are aligned and T-plates are secured to these edges as described above. The wall modules may be provided with access openings, such as doors for ingress into and egress from the interior of the building and windows for light and air, which are framed by T-plates.

20 Claims, 12 Drawing Figures

MODULAR BUILDING CONSTRUCTION

INTRODUCTION

The present invention relates to modular building construction utilizing modules comprising two rigid sheets of insulating material held together at one or more edges by a T-plate and to modules used in such construction. A T-plate is a structural unit of any desired or necessary length comprising a head and a stem fastened normal to said head at an intermediate position between the edges of the head, generally central thereto.

BACKGROUND OF THE INVENTION

Proposals have heretofore been made to construct buildings, in part at least, of modules. Among these prior proposals are the buildings and articles disclosed and illustrated in the United States letters patent granted to:

Massare, U.S. Pat. No. 664,658, granted Dec. 25, 1900.

Carpenter, U.S. Pat. No. 2,287,229, granted June 23, 1942.

Spencer, U.S. Pat. No. 2,304,034, granted Dec. 1, 1942.

Olsen, U.S. Pat. No. 2,499,278, granted Feb. 28, 1950.

Anderson, U.S. Pat. No. 2,546,290, granted Mar. 27, 1951.

Rosenberg, U.S. Pat. No. 2,582,935, granted Jan. 15, 1952.

Bergstrom, U.S. Pat. No. 2,904,849, granted Sept. 22, 1959.

Borlenghi, U.S. Pat. No. 3,130,455. granted Apr. 28, 1964.

Young, Jr., U.S. Pat. No. 3,246,432, granted Apr. 19, 1966.

Levine, U.S. Pat. No. 3,319,389. granted May 16, 1967.

Pate, U.S. Pat. No. 4,215,972, granted Nov. 21, 1978.

These prior proposals of building and article construction, at least in part of modules, show a long felt but unsatisfied need in the art for modular building construction but none of them has fulfilled the need satisfactorily.

SUMMARY OF THE INVENTION

The present invention includes modules for floors, walls, ceilings and roofs of buildings which enable attractive buildings of many different designs and sizes to be constructed rapdily at relatively low cost utilizing unskilled labor. The walls of the buildng include doors and windows. The roof may include solar panels to provide energy for heating water and interior space within the building.

Modules for floor construction include at least two sheets of rigid, foamed plastic, at least one of the sheets being rabbeted at each edge where the two panels have aligned edges to receive and be secured to the stem of a T-plate. The sheets are adhesively secured together at their contacting faces. Each module preferably comprises two sheets which have the same with and length but they are preferably offset by about 50% of the width and length to give a staggered arrangement to the sheets in the two layers which greatly increases the carrying capacity of the floor. Around the periphery of the floor half-size sheets are used to fill in the area from the outside edges of one sheet to the offset edges of the second sheet of the module. At each edge where a T-plate is used, the stem is adhesively secured in the rabbett and the head is adhesively secured to the aligned edges of the two sheets. The stem of the T-plate preferably has a width corresponding to the depth of the rabbett. The exposed face of the upper sheet of rigid plastic preferably is covered by a flooring material, e.g., a plywood sheet, which is adhesively secured thereto. The exposed face of the lower sheet may also be faced with a plywood sheet, if desired. The width of the head of the T-plate generally corresponds to the thickness of the module.

Modules for ceiling construction may be similar to the floor modules but in many buildings constructed in accordance with the invention no separate ceiling is provided because the roof modules serve the functions of both roof and ceiling.

Modules for wall construction include two sheets of such plastic with surrounding T-plates in which the stem serves to separate the two sheets to provide a space between them. The space serves a number of functions. One is to increase the insulating effectivenes of the module. Another is to provide space for electric wiring. A further function is to provide a space for plumbing and water pipes. If desired, spacer members, e.g., blocks, horizontal strips or girts and vertical strips, having the same thickness as the stem may be provided to give added strength and rigidity to the wall sheets of the module. The face of the wall module which is to be outside of the building preferably is faced with a suitable material for an exterior wall, e.g., outdoor plywood, cedar boards, and the like. The face of the wall module which is to be inside the building preferably is faced with a suitable material for an interior wall, e.g., sheet rock, pre-finished wall paneling, plywood sheets suitable for painting, wall papering, and the like.

The roof modules include two sheets of rigid, foamed plastic. They may be spaced apart as are the sheets of the wall modules or adhesively bonded together as the sheets are in the floor modules. T-plates are used at least on the lower ends of roof modules in buildings having a cornice where the head serves as facia. The upper ends of the roof modules which form the ridge of the roof are beveled to form a vertical end wall when the module is laid on the roof, i.e., the angle of the bevel conforms to the pitch of the roof so that the upper ends of the modules on opposite sides of the roof match where they meet and a V-plate is used to join them together. As in the wall modules, the interior and exterior surfaces of the roof modules may be faced with suitable interior and exterior coverings.

The sizes of the modules may be adapted to the design of the building. For example, the floor modules may be four (4) feet wide as long as the room in which they are to be used is wide, so that they are suppoorted at one end on the foundation that surrounds the building and at the other end by an interior pile, or the like. Ceiling modules, when used, may be similarly sized to rest at one end on the exterior wall modules and at the other end on an interior partition wall. The wall modules may be four (4) feet wide and as high as the ceiling, if ceiling modules are used, or as high as the roof module where it serves also as the ceiling, e.g., some seven (7) to nine (9) feet. The roof modules may also be four (4) feet wide and long enough to extend from cornice to ridge (in single slope roofs), or from cornice to mansard break and from mansard break to ridge where the length of the roof is greater than desired for single roof modules.

BRIEF DESCRIPTION OF THE DRAWINGS

The invention is illustrated in the drawings in which.

DETAILED DESCRIPTION OF PREFERRED EMBODIMENTS OF THE INVENTION

Figure 1:
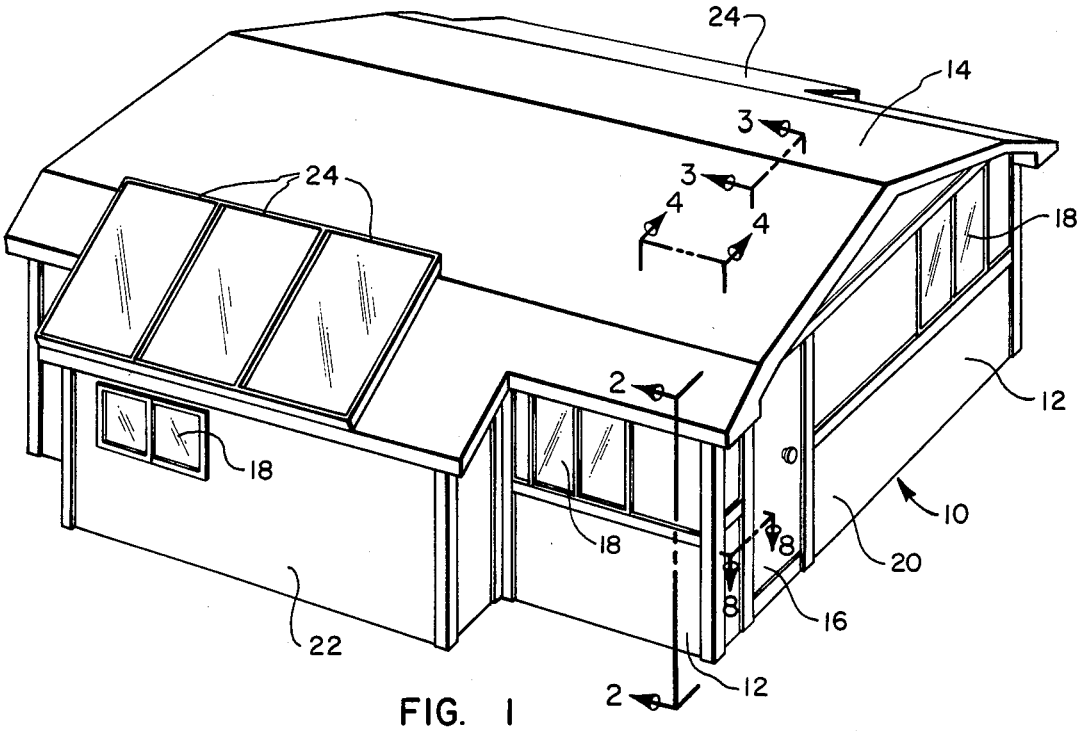
FIG. 1 is an isometric view of a simple building, specifically a house, constructed of modules in accordance with the invention.

The modular building construction of the present invention comprises wall and roof modules, and optionally also floor and ceiling modules. Each module comprises at least two sheets of rigid, foamed plastic, e.g., foamed polyurethane, polystyrene, and the like, and a T-plate secured to at least one edge. Each T-plate comprises a head piece and a stem piece fastened to the head piece. The stem of the T-plate is secured to the adjacent edges of both foamed plastic sheets with the head piece engaging the edges thereof. The foamed plastic sheets may be adhesively bonded together or may be separated by the stem of the T-plates at the edge or edges and any reinforcing means to provide an internal air space. In the embodiment of the invention in which the sheets are adhesively bonded together, at least one of them is rabbeted to provide space for the stem of the T-plate.

Two embodiments of support for roof modules by the wall modules are specifically disclosed and illustrated in the drawings. One embodiment illustrated in FIGS. 2 and 5 comprises a right triangular roof module support on top of wall modules in which the hypotenuse is at an angle to the horizontal corresponding to the pitch of the roof at the line of support. A second embodiment, illustrated in FIG. 10, comprises beveled edges of adjacent wall and roof modules having opposed grooves to receive the respective arms of a V-plate, the angle of the bevel with respect to the surface of the module being the pitch of the roof module.

Figure 9:
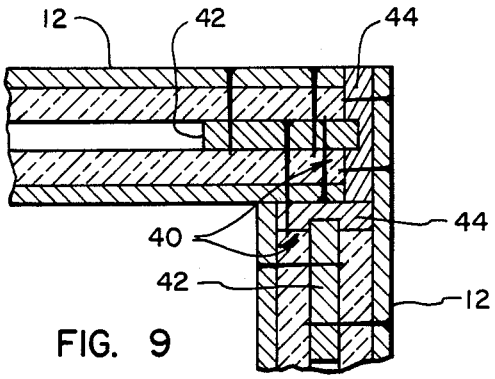
FIG. 9 is a fragmentary horizontal section illustrating one embodiment of corner construction.
Figure 11:
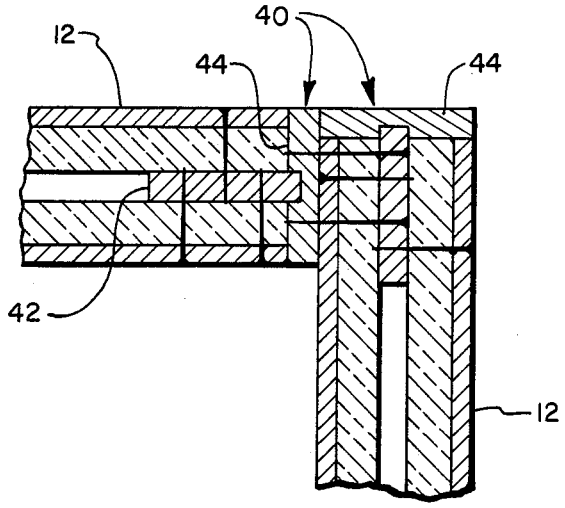
FIG. 11 is a fragmentary horizontal section of a second embodiment of corner construction.

Two embodiments of corner construction are illustrated in FIGS. 9 and 11. In the embodiment of FIG. 9 each corner wall module has a T-plate on the outer edge and the head of the T-plate of a first wall module is wide enough only to extend to the outside surfaces of the two sheets, i.e., it does not extend to the exposed surface of any covering material. This head engages the surface of the second wall module with the outside surface of the head of the T-plate of the second module aligned with the outside surface of the head of the first wall module. The outside covering of the first wall module extends to the outer edge of the head of the T-plate of the second wall module. The interior covering of the first module goes to the inner corner of the two wall modules. In the second embodiment of corner construction, each of the adjacent vertical edges of the wall modules has a T-plate in which the head extends to the outer surface of the module, the T-plate of the first wall module engages the surface of the second wall module with the outer edge of its head aligned with the outer surface of the head of the second wall module.

Referring now more particularly to FIG. 1, the building illustrated, which is referred to generally by reference number 10, is constructed of wall modules 12 and roof modules 14. A door 16 and a window 18 are provided in the front wall 20. The side wall 22 shown in FIG. 1 has windows 18 in it and similar windows may be provided in the other side wall and the rear wall, which may also have a door opening, as desired. A lean-to 23 is provided on one wall, e.g., on wall 22, to serve as solar and water storage area below solar panels 24 in the roof. A bathroom (not shown) may be provided in the building, if desired, and it is convenient to locate it near the lean-to 23. A second lean-to 24 may be provided on the other side of the building which may be similar in size and shape to lean-to 23 to provide closet space for a bedroom and storage space for a combined living, dining and kitchen area (not shown) within the building. The lean-tos may have any desired length and width and may begin at the back corner of the side wall or indented from it, as shown in FIG. 1. The floor plan of the building, i.e., the size and location of rooms and facilities, is not deemed a part of the present invention and may be chosen to fit the needs of the prospective occupant(s) of the house.

Figure 2:
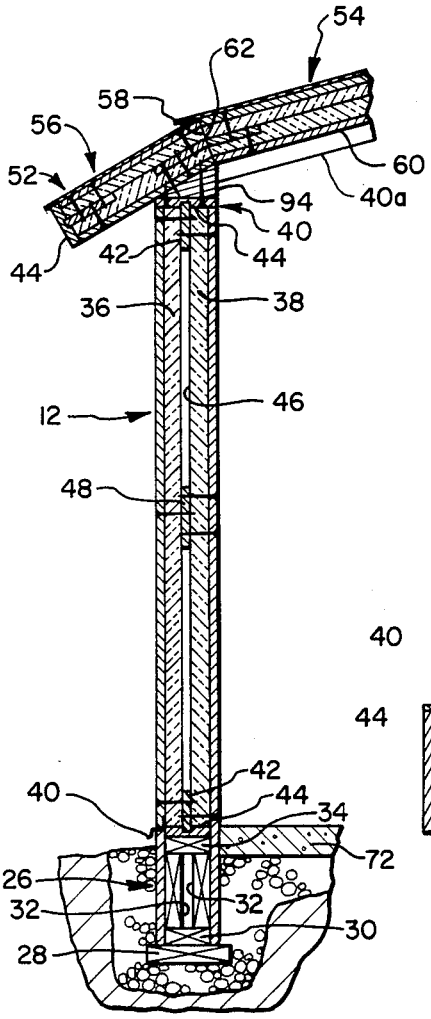
FIG. 2 is a vertical section along the line 2—2 of FIG. 1.

As illustrated in FIG. 2, building 10 includes an underground foundation 26 which, in this embodiment of the invention, comprises a footing plank or plate 28, e.g., a 2×8; a base plate 30, e.g., a 2×4; two joists 32, e.g., 2×8s; and a top plate 34, e.g., a 2×4. The timbers that are underground during use are preferably treated with chemicals which preserve the wood from deteroriation, e.g., creosote.

Figure 12:
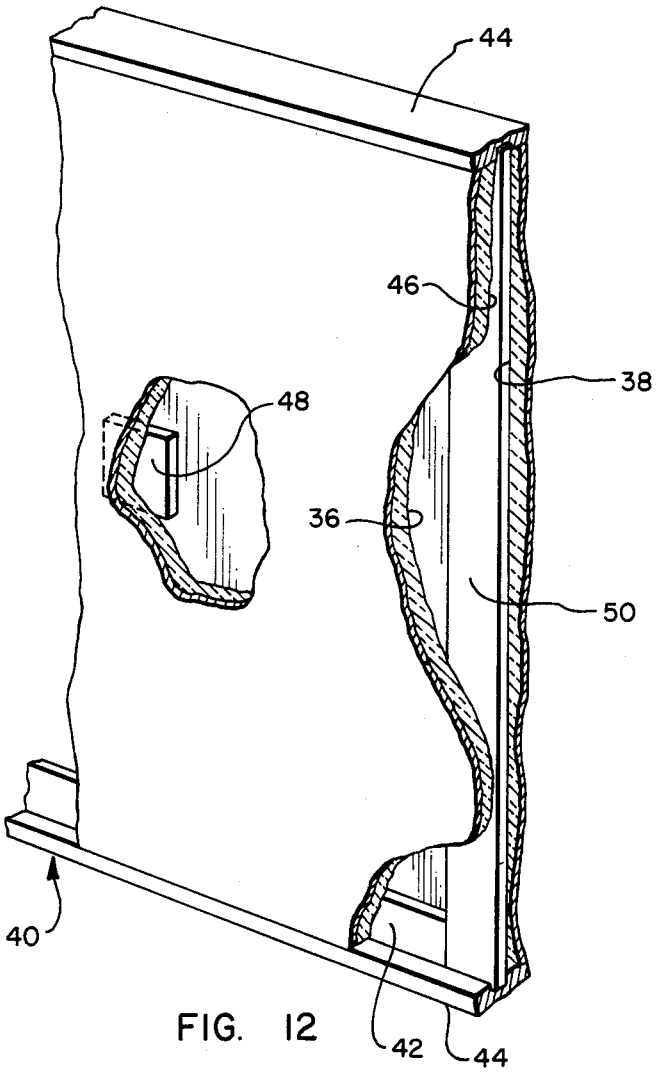
FIG. 12 is a fragmentary isometric view, partly in section, illustrating a reinforced wall module.

Above and supported by the foundation 26 is a wall module 12 comprising an outer sheet 36 of rigid foamed plastic, e.g., foamed polyurethane, foamed polyurethane, and the like, an inner sheet 38 of material of the same type and at least one T-plate 40 having its stem 42 between and secured to the sheets and its head against and secured to the ends of the adjacent sheets 36 and 38. The two sheets in this embodiment of the invention are spaced by the stem 42 to form an insulating air space 46 which adds to the insulating effectiveness of the module and provides space for electric wiring, water pipes, sewer pipes, and the like. In some cases it is advisable to place spacing blocks 48 and/or spacing strips or girts horizontally and/or spacing strips vertically horizontally in the space 46 and adhesively bond them to at least one, and preferably both, of the adjacent rigid sheets. The spacing strips 50 may extend across the space 46 between the stems or the stems may be cut away to permit the strip 50 to extend across the space 46 as far as the head 44 of the T-plates on opposite sides or ends of the module, as illustrated in FIG. 12.

Roof 14 may have a single slope from eaves, e.g., cornice or wall module, to ridge or it may comprise plural slopes, as in mansard roofs. In the embodiment of the invention illustrated in FIGS. 1, 2 and 5, a mansard-type roof is illustrated comprising a lower portion 52 of greater or steeper slope and an upper portion 54 of less steep slope. In constructing a mansard roof, each of these two portions is constructed of roof modules arranged side by side from one end of the roof to the other.

Two embodiments of joints between the upper and lower portions are illustrated in the drawings. One embodiment shown in FIG. 2 comprises a lower module 56 having an upper beveled end 58 and an upper module 60 having a beveled lower end 62. Each bevel, in effect, bisects the angle formed by the two modules and a V-plate may be used to connect them, as illustrated in FIGS. 1, 2, 3 and 10. The second embodiment, illustrated in FIG. 5, comprises a lower module **52*a* having T-plates at upper and lower ends and an upper module 54*a* having a beveled lower end with a groove extending inwardly therefrom to receive a fastening strip 96, like one arm of a V-plate, preferably adhesively secured in said groove. Fastening means, e.g., long screws, pass from the outside surface of the outer foamed plastic sheet through fastening strip 96 and into head 44*a* of the T-plate 40*a*. The outer covering material 58*a* of the upper module 54*a*** preferably extends beyond the end of the module to carry water flowing down its outer surface well beyond the joint between the upper and lower modules.

Two embodiments of the upper end of a wall module are illustrated. In one embodiment, illustrated in FIGS. 2, 5 and 12, the upper end has a T-plate 40 secured therein, in the manner previously described. In the second embodiment, illustrated in FIG. 10, the upper end of the wall module 12 and the lower end of the roof module 14 are beveled at an angle which bisects the pitch angle of the roof module. Grooves are provided in these beveled ends between the two sheets of foamed plastic to receive the two arms of a V-plate which are secured adhesively in their respective gooves. A V-shaped joint cover plate 68 may be used to cover the joint between the wall and roof modules and it preferably is adhesively secured in water-tight relation to the roof modules by water-resistant adhesive. A decorative molding 70 may be used in the inner corner for esthetic purposes.

Figure 5:
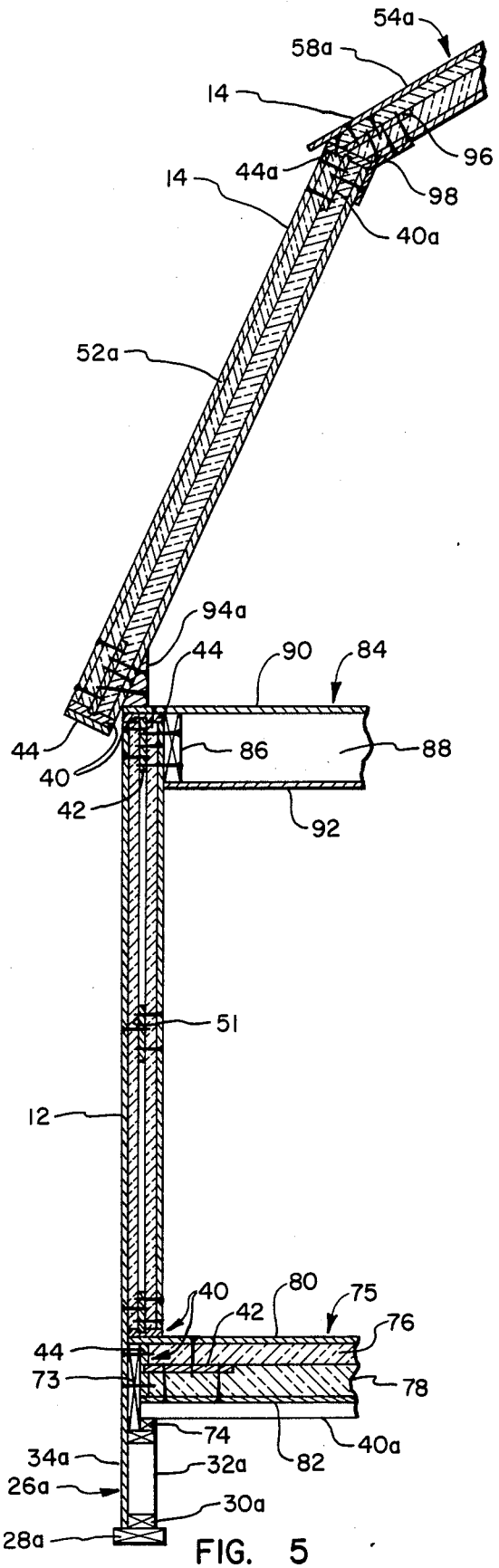
FIG. 5 is a vertical section of a two story building having a mansard roof with the steeper lower modules forming the exterior wall of the second floor.

Two embodiments of floor construction are illustrated in FIGS. 2 and 5. In the embodiment illustrated in FIG. 2, the fllor 72 is a slab of cement concrete laid on a gravel bed and it extends on each side to the foundation 26. In the embodiment of FIG. 5 the modular floor 75 is supported at its outer edges by a foundation of somewaht different construction than the foundation illustrated in FIG. 2 in that is comprises a footing plate **28*a* like 28, a base plate 30*a* like 30, but instead of joists 32 studding 32*a* are used on the upper ends of which an upper plate 34*a* is fastened. Resting on and secured to upper plate 34*a* are a wide ring joist 73, e.g., a 2×12, and a narrow ledge joist 74, e.g., a 2×4, which together support the floor 75 which comprises two sheets of rigid, foamed plastic 76 and 78 having a T-plate 40 secured in the outer end of each floor module. An upper floor facing material 80 covers the upper surface of the floor modules and it extends over and is supported by ring joist 73. A lower facing material 82 covers the lower surface of each floor module which rests on and is supported by narrow or ledge joist 74. The wall modules rest on and are supported by the outer edge of the upper facing material 80 and it is preferred to extend the outer facing material of the wall modules from the upper T-plate 40 of the wall module to the footing plate 28*a*, as shown in FIG. 5, particularly where the foundation 26*a*** is not completely buried in the ground. Many building codes require a crawl space of about eight (8) inches or more under a floor such as this modular floor and it is convenient to have the ground level the same inside and outside the foundation.

Building 10 is illustrated as a one-story structure. The sectional view FIG. 2 shows the roof modules 58 serving both as roof and ceiling of the building. Multi-story buildings may also be constructed in accordance with the invention, as illustrated in FIG. 5 for a two-story structure. In this embodiment of the invention, the ceiling of the first story is the floor 84 of the second story. This floor-ceiling comprises a joist header 86 fastened to the inner face of wall module 12 with its upper edge aligned with the upper side of T-plate 40 at the top of the wall module. Joists 88 are fastened to the header 86 in the usual framing manner and extend across the room to rest at the other end on a partition wall or on the top of the wall modules at the other side of the building. Floor 90 is fastened to the upper edges of the joists 88 and it extends at the edges to the outer side of heads 44 of T-plates 40 which support it. The ceiling facing material 92 is fastened to the lower edes of the joists 88. This same construction can be used for a third and higher floors for multi-story buildings of any size, as desired.

Figure 10:
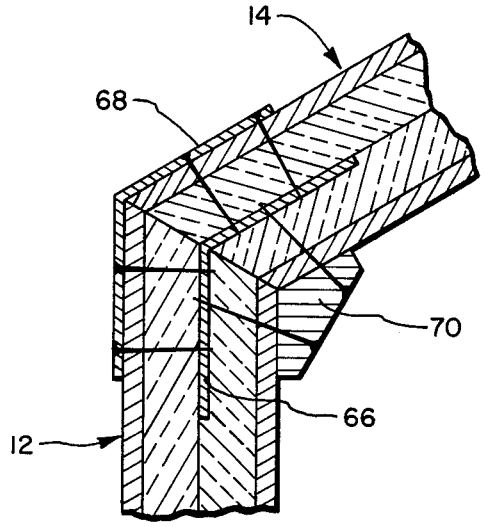
FIG. 10 is a fragmentary vertical section of one embodiment of connection between wall and roof modules where no cornice is provided.

Two embodiments of roof support are illustrated in FIGS. 2 and 5 and FIG. 10. In the first embodiment, as illustrated in FIG. 2, a right-angle roof support and fastening means 94 is fastened along the top T-plate 40 of the wall modules. The hypotenuse of means 94 is at an angle to the horizontal corresponding with the pitch of the roof module it supports and fastens to the wall modules by means of long nails or screws which extend from the upper surface of the inner facing sheet, and/or from the upper surface of the stem and/or from the upper surface of the outer facing sheet into the support and fastening means 94.

In the first embodiment illustrated in FIG. 5, a right-angle roof support means **94*a* is fastened along the edge of floor 84 which rests on and is supported by upper T-plate 40 of wall modules 12. The angle of the hypotenuse of 94*a* with respect to the horizontal corresponds to the pitch of roof module 52*a***.

In the second embodiment illustrated in FIG. 10, the upper ends of the wall modules and the lower ends of the roof modules are beveled at an angle which bisects the pitch angle, as described above.

Figure 6:
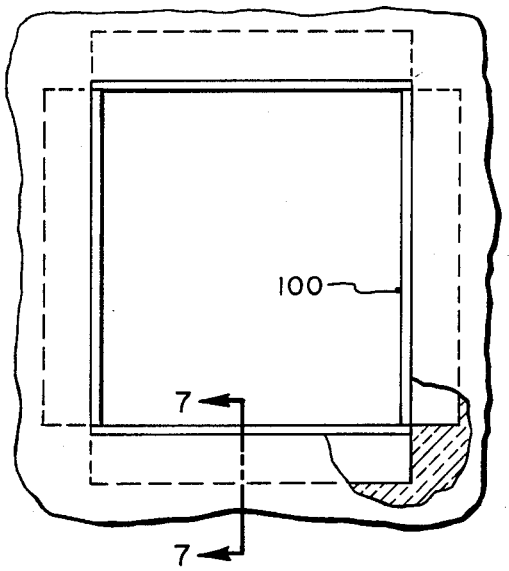
FIG. 6 is a fragmentary elevation, partly in section, of an access opening in a wall module showing how T-plates may function as frame for the opening.
Figure 7:
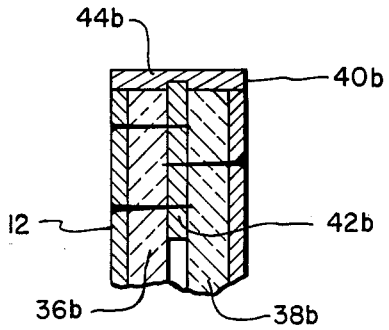
FIG. 7 is a vertical sectional view along the line 7—7 of FIG. 6 on a somewhat larger scale.
Figure 8:
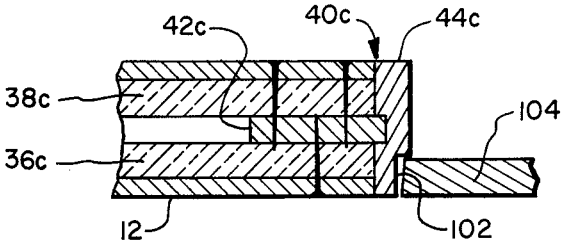
FIG. 8 is a cross sectional view along the line 8—8 of FIGS. 1 and 6 showing the head of a T-plate serving as a jamb of a frame for the access opening, either door or window, having a rabbett to receive the sash and door.

Acess openings for windows and doors are provided, as desired, in wall modules 12. These access openings include windows for access to light and air and door openings for access to light and air and for ingress and egress. FIG. 6 shows a window opening 100 having T-plates surrounding it. FIG. 7 is a section on the line 7—7 of FIG. 6 showing T-plate **40*b* with its stem 42*b* secured to and spacing sheets 36*b* and 38*b*. The head 44*b* forms the sill of the window. FIG. 8 is a section along the line 8—8 of both FIGS. 1 and 6. It shows the T-plate 40*c* with its stem 42*c* secured to and spcing sheets 36*c*** and 38*c* of the wall module 12 and its head 44*c* forming the jamb for the access opening. It preferably is rabbeted at 102 to receive the sash or door 104.

Figure 3:
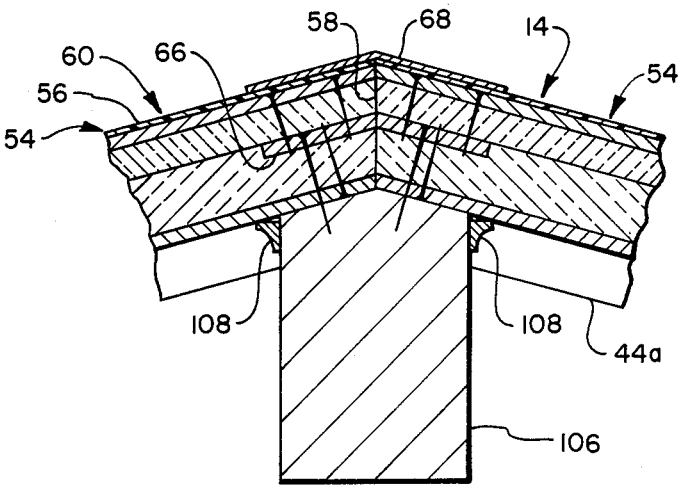
FIG. 3 is a cross section along the line 3—3 of FIG. 1.

FIG. 3 illustrates the construction of the roof at the ridge. A ridge pole 106 is supported at its ends in the gables at front and rear of the building 10. Its upper edge is sloped on each side to conform with the sheets of the module. The face of the wall module which is to be outside the building preferably is faced with a suitable material for an exterior wall, e.g., outdoor plywood, cedar boards, and the like. The face of the wall module which is to be inside the building preferably is faced with a suitable material for an interior wall, e.g., sheet rock, pre-finished wall paneling, plywood sheets suitable for painting, wall papering, and the like. The angle of the beveled ends is a bisect of the pitch angle. Grooves in each beveled end receive the respective arms of a V-plate 66. V-shaped joint cover 68 is adhesively secured to the roof covering on each side of the ridge, preferably by waterproof adhesive. A decorative molding 108 may be fastened on each side of the ridge pole where it intersects with the interior finishing material on the underside of the module.

Figure 4:
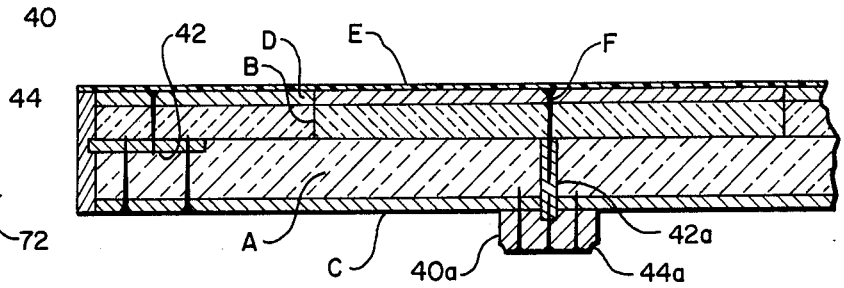
FIG. 4 is a cross section along the line 4—4 of FIG. 1.

FIG. 4 illustrates the joint between the side edges of two floor and ceiling modules in which the lower and upper sheets of foamed plastic A and B are offset. Sheet A is illustrated as beginning with the T-plate 40 at its left edge and it extends to the right for its predetermined width, e.g., four (4) feet. A narrow, preferably half-width, sheet B overlies the left half of sheet A at the left edge and the T-plate is secured in these left edges in the manner already fully described above. Next to the half sheet is a full sheet B which thus overlies the joint between the two adjacent lower sheets A. The lower surface of the module has a facing sheet C, the upper surface has a facing sheet D, and where it is a roof module it also has the outer roofing sheet E, as previously described. A T-plate 40*a* having a stem which extends just to the top of sheet A is secured to the two adjacent sheets A, e.g., by adhesive and by fasteners F which extend from the upper surface of facing sheet D into the stem 42*a* and by fasteners pasing from the under surface of head 44*a* into the lower facing sheet C. The head 44*a* in this T-plate 40*a* is preferably shaped to form a decorative molding. The same type of joint structure is used at the ends of the foamed plastic sheets where two adjacent lower foamed sheets A have a T-plate 40*a* secured between them, the upper foamed sheet B and its facing sheet D span the joint between the lower sheets and has long nails or screws passing from the upper facing sheet D into the stem 42*a*, just as illustrated in FIG. 4. This manner of forming the floor and roof modules greatly increases the load bearing strength of the floor, ceiling and roof of the building.

The invention has been described in connection with certain specific embodiments but it will be understood by those skilled in the art that these specific embodiments are illustrative of and not limitions on the invention. Modifications and variations in details of the modules and other parts of the invention may be made without departing from the spirit and scope of the invention as set forth in the appended claims.

Having thus described and illustrated the invention, what is claimed is:

1. A modular building construction comprising wall and roof modules, each wall module comprising at least two sheets of rigid, foamed plastic having aligned top and bottom edges and at least some of said wall modules defining corner wall modules having outer side edges, and a T-plate on each edge of each module which has aligned edges, said T-plate comprising a head piece and a single stem piece fastened to said head piece, the stem piece of said T-plate being secured between the sheets at said aligned edges said sheets and stem forming the thickness of the module and the head piece having a width equal to the thickness of the module being secured to the aligned edges of the two sheets.

2. A modular building construction as set forth in claim 1 in which the two sheets of rigid, foamed plastic are in face to face contact and are adhesively secured together at their contacting faces, at least one of said sheets being rabbeted on at least one aligned edge to receive the stem of a T-plate.

3. A modular building construction as set forth in claim 1 in which two sheets of rigid foamed plastic are secured at aligned edges to opposite sides of the stem of a T-plate and are spaced from each other thereby with the head of the T-plate secured to the aligned edges of the two sheets.

4. A modular building construction as set forth in claim 1 in which each module has a surface finishing material secured to the exposed surface of each sheet of rigid foamed plastic.

5. A modular building construction as set forth in claim 4 in which the outside surface of each sheet of foamed plastic has an exterior-type finishing material secured to it and the inside surface of each sheet of foamed plastic has an interior-type finishing material secured thereto.

6. A modular building construction as set forth in claim 1 in which the roof modules are supported by the wall modules and exterior surfaces of each sheet of foamed plastic in the roof modules has an exterior-type of material including a roof membrane and the inside surface of each sheet of foamed plastic has an interior-type finish material secured thereto.

7. A modular building construction as set forth in claim 5 in which a wall module has an access opening and the opening has T-plates on at least the two sides and the top of the opening, the stems of said T-plates being secured to the sheets of foamed plastic and the heads forming the frame of the opening.

8. A modular building construction as set forth in claim 7 in which the access opening is a window and a T-plate is secured to the bottom of the opening to form a sill.

9. A modular building construction as set forth in claim 7 in which the access opening is a door.

10. A modular building construction as set forth in claim 7 in which the head of each T-plate is rabbeted to receive a closure member for the opening.

11. A modular building construction as set forth in claim 1 comprising wall modules moving a right triangular roof module support secured to the head of the T-plate at the upper edge thereof in which the hypotenuse of said support is at an angle to the horizontal corresponding to the pitch of the roof, the roof module is secured to said support a predetermined distance from its lower end to provide a cornice, a ridge pole, upper roof module which overlay half of the ridge pole having its upper end beveled at an angle corresponding to said pitch and is engaged with the beveled end of the roof module on the other side of the roof, the upper end of at least one foamed plastic sheet of each roof module being rabbeted to receive an arm of a V-plate, and a V-plate having one arm secured in each roof module.

12. A modular building construction comprising wall and roof modules, each wall and roof module comprising at least two sheets of rigid, foamed plastic, each wall module having aligned edges of said two sheets at the bottom and at least the outer side edge of a corner module, a T-plate having a single stem and a head to which the stem is secured approximately midway between the side edges of the head and which has a width corresponding to the thickness of the module, said stem being secured to the foamed plastic sheets in a groove between the two foamed plastic sheets at the aligned edges and the head being secured to the aligned edges of the sheets, said wall modules having an upper beveled end, said roof modules comprising two sheets of foamed plastic, upper and lower facing sheets bonded to the inner and outer surfaces thereof and having a lower beveled end abutting the upper beveled end of said wall modules, a groove formed in each beveled end of roof and wall modules at the adjacent inner faces of said sheets in said modules, and the beveled ends of said wall and roof modules are secured together by means including a V-plate having one arm secured to said wall module and the other secured to said roof module in said grooves.

13. A modular building construction as set forth in claim 1 in which the sheets of foamed plastic material are offset laterally from each other about 50% of their width at the junctions between adjacent sheets of a wall, and side edges of adjacent modules have a space between them to receive and be secured to the stem of a T-plate of which the stem has a width corresponding to the thickness of the sheet and the head thereof forms a decorative molding.

14. A modular building construction as set forth in claim 1 in which corner wall modules are vertically joined with the head of the T-plate of a first wall module engaging the surface of the second module with an outer lateral edge of the T-plate of the first module aligned with the head of the T-plate of the second module and the first module having an exterior surface finish material which also covers the head of the T-plate of the second module.

15. A modular bulding construction as set forth in claim 1 in which corner modules are joined together vertically with the head of the T-plate of a first wall module engaging the surface of the second wall module and the outside surface of the head of the T-plate of the second module being aligned with the outside surface of the first wall module.

16. A modular building construction as set forth in claim 3 which further includes at least one spacer block secured to the adjacent surfaces of both sheets of foam plastic.

17. A module for use in modular building construction which comprises at least two sheets of rigid, foamed plastic material having aligned edges on at least one edge of the module, a T-plate comprising a head and a single stem fastened thereto having its stem between and secured to opposed faces of said sheets which are in contact with it said foamed plastic sheets and stem forming the thickness of the module and with its head having a width equal to the thickness of the module against and secured to the aligned edges of the two sheets.

18. A module as set forth in claim 17 in which the two sheets of foamed plastic are adhesively secured to said stems in spaced relation from each other and reinforcing means of a thickness corresponding to said stems is adhesively secured to at least one of the opposed faces of the sheets at a position intermediate of the edges of both sheets.

19. A module as set forth in claim 17 in which the two sheets of foamed plastic are in contact with and adhesively secured to each other and a groove is formed by a rabbet in at least one of said sheets, the stem of said T-plate being received in and secured to the walls of said groove.

20. A modular building construction as set forth in claim 1 in which the roof modules comprise overlying sheets of rigid, foamed plastic material of about the same width and length which are offset laterally from each other about 50% of their length and width, partial sheets of said rigid, foamed plastic material filling openings left by said offset relationship to form aligned edges of the two sheets around at least three sides of the periphery of a plurality of such sheets constituting a roof section, a groove formed by a rabbet in at least one edge of said sheets at the edge of the module where edges of the two sheets are aligned, T-plates secured to said aligned edges with their stems in and secured to the wall of said groove and their heads adhesively secured to said aligned edges, and a joint T-plate having its stem in and adhesively secured to the opposed edges of two sheets of foamed plastic material at the joint between them, said stem having a width corresponding to the thickness of the bottom sheets to which the stem is so secured, and fastening means securing the upper sheet to the stem of said joint T-plate.

* * * * *